US007464569B2

(12) United States Patent
Kolton et al.

(10) Patent No.: US 7,464,569 B2
(45) Date of Patent: Dec. 16, 2008

(54) ZIPPER TAG HOUSING

(75) Inventors: Chester Kolton, Westfield, NJ (US); Michael Norman, East Brunswick, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 11/706,773

(22) Filed: Feb. 15, 2007

(65) Prior Publication Data

US 2007/0186597 A1 Aug. 16, 2007

Related U.S. Application Data

(60) Provisional application No. 60/773,545, filed on Feb. 15, 2006.

(51) Int. Cl.
*E05B 73/00* (2006.01)

(52) U.S. Cl. ..... 70/57.1; 24/381; 24/386; 24/429; 40/653; 70/68; 292/307 R; 292/307 A; 292/318; 340/572.9

(58) Field of Classification Search ..... 70/57.1, 70/68, 63, 58–61; 206/1.5; 340/572.8, 572.9; 40/653; 292/307 R, 307 A, 307 B, 317–321; 24/429, 381, 386, 390
See application file for complete search history.

(56) References Cited

U.S. PATENT DOCUMENTS

| | | | | | |
|---|---|---|---|---|---|
| 204,226 | A * | 5/1878 | Hunter | 292/318 |
| 1,759,283 | A * | 5/1930 | Schmidt | 70/68 |
| 1,759,284 | A * | 5/1930 | Schmidt | 70/68 |
| 1,819,349 | A * | 8/1931 | Walrath | 70/68 |
| 1,898,974 | A * | 2/1933 | Legat | 70/68 |
| 1,930,560 | A * | 10/1933 | Keidel | 292/318 |
| 1,976,089 | A * | 10/1934 | Peake | 292/328 |
| 1,987,351 | A * | 1/1935 | Rose | 292/328 |
| 2,006,051 | A * | 6/1935 | Keidel | 292/328 |
| 2,051,367 | A * | 8/1936 | Carlson | 292/318 |
| 2,368,613 | A * | 2/1945 | Perrotta | 292/318 |
| 3,319,743 | A * | 5/1967 | Pelavin et al. | 190/120 |
| 3,597,945 | A * | 8/1971 | Feinberg | 70/68 |
| 3,965,706 | A * | 6/1976 | Davis | 70/68 |
| 3,995,900 | A * | 12/1976 | Humble et al. | 70/57.1 |
| 4,460,203 | A * | 7/1984 | Moberg et al. | 292/318 |
| 4,792,026 | A * | 12/1988 | Dimmick et al. | 190/101 |
| 5,031,944 | A * | 7/1991 | Keyaki | 292/307 R |
| 5,119,652 | A * | 6/1992 | Costa | 70/57.1 |
| 5,136,864 | A * | 8/1992 | Spiekermann et al. | 70/68 |
| 5,140,836 | A * | 8/1992 | Hogan et al. | 70/57.1 |
| 5,421,177 | A * | 6/1995 | Sieber et al. | 70/57.1 |
| 5,437,172 | A * | 8/1995 | Lamy et al. | 70/57.1 |
| 5,557,954 | A * | 9/1996 | Ling | 70/68 |
| 5,689,979 | A * | 11/1997 | Yu | 70/69 |
| 5,927,110 | A * | 7/1999 | Yu | 70/68 |
| 6,189,249 | B1 * | 2/2001 | Hughes | 40/662 |
| 6,279,358 | B1 * | 8/2001 | Costa | 70/57.1 |
| 6,308,539 | B1 * | 10/2001 | Kolton et al. | 70/57.1 |
| 6,308,541 | B1 * | 10/2001 | Stowe | 70/68 |

(Continued)

*Primary Examiner*—Lloyd A Gall
(74) *Attorney, Agent, or Firm*—Hoffmann & Baron, LLP

(57) ABSTRACT

A housing for supporting an electronic tag on a zipper for a zippered container including a housing and an electronic tag supported by the housing. The housing has a configuration which is attached to at least one zipper of a zippered container. The housing is attached to the exterior of the container to limit movement of the zipper about the container.

14 Claims, 4 Drawing Sheets

U.S. PATENT DOCUMENTS 6,311,531 B1 * 11/2001 Sykes ..... 70/57.1
6,317,046 B1 * 11/2001 Fresnel et al. ..... 340/572.9
6,330,758 B1 * 12/2001 Feibelman ..... 40/299.01
6,347,885 B1 * 2/2002 Buchman ..... 383/5
6,543,261 B2 * 4/2003 Kolton et al. ..... 70/57.1
6,612,139 B1 * 9/2003 Costa ..... 70/57.1
6,694,655 B2 * 2/2004 Redburn et al. ..... 40/664
6,731,212 B2 * 5/2004 Hirose et al. ..... 340/572.9
6,788,216 B2 * 9/2004 Chen ..... 340/693.5
6,920,769 B2 * 7/2005 Huehner ..... 70/57.1
6,933,847 B2 * 8/2005 Feibelman ..... 340/572.1
7,086,255 B2 * 8/2006 Reason ..... 70/2
7,129,841 B2 * 10/2006 Feibelman ..... 340/568.1
2003/0145636 A1 * 8/2003 Nykoluk ..... 70/68
2004/0237605 A1 * 12/2004 Lin et al. ..... 70/68
2006/0016531 A1 * 1/2006 Volk et al. ..... 150/102
2007/0068202 A1 * 3/2007 Kolton et al. ..... 70/57.1

* cited by examiner

ZIPPER TAG HOUSING

CROSS-REFERENCE TO RELATED APPLICATIONS

The present application claims priority to Provisional Application No. 60/773,545, filed Feb. 15, 2006, and entitled, "A ZIPPER TAG HOUSING", herein incorporated by reference.

FIELD OF THE INVENTION

The present invention relates to an electronic tag housings used to support electronic tags. More particularly, the present invention relates to a zipper tag housing which supports an electronic tag and which limits access to products contained within a zippered container.

BACKGROUND OF THE INVENTION

It is widely known to use electronic tags for various purposes. Electronic article surveillance (EAS) tags as well as radiofrequency identification (RFID) tags are used for purposes such as tracking sales and shipments of products to which they are attached. They also may be used to provide theft deterrence to articles to which they are attached.

It is also known to apply such electronic tags to various product containers for tracking product, provide product information and/or security purposes. Commonly assigned U.S. Pat. Nos. 6,696,955 and 6,324,838 show housings for EAS markers which are used in combination with containers having an inlet/outlet port. The marker housing is configured to be passable through the port for residence within the container.

Devices which provide tamper evidence specifically directed to zipper mechanisms are shown in U.S. Pat. Nos. 6,347,885 and 6,257,763. These devices are directed to providing a completely new design for the zippering mechanism.

While these devices serve adequately for its intended purpose, it is desirable to provide an electronic tag housing which may be easily applied to the exterior surface of a variety of zipping mechanisms.

It is desirable to provide an electronic tag housing which may be easily applied to the exterior packaging zipper of a product, and provide for limited access to a packaged product therein.

SUMMARY OF THE INVENTION

The present invention is directed to a housing for supporting an electronic tag on a zipper for a zippered container. The housing is designed to support an electronic tag. The housing has a configuration which is attached to at least one zipper of a zippered container. The housing is attached to the exterior of the container to limit movement of the zipper about the container.

DESCRIPTION OF THE INVENTION

The present invention provides a housing for supporting an electronic tag such an electronic article surveillance (EAS) tag or a radio frequency identification (RFID) tag. The housing is designed to attach to the zipper and/or zipper packaging so as to be unobtrusive and so that its position will not interfere the ability of a potential purchaser to have limited access to the product within.

Figure 1:
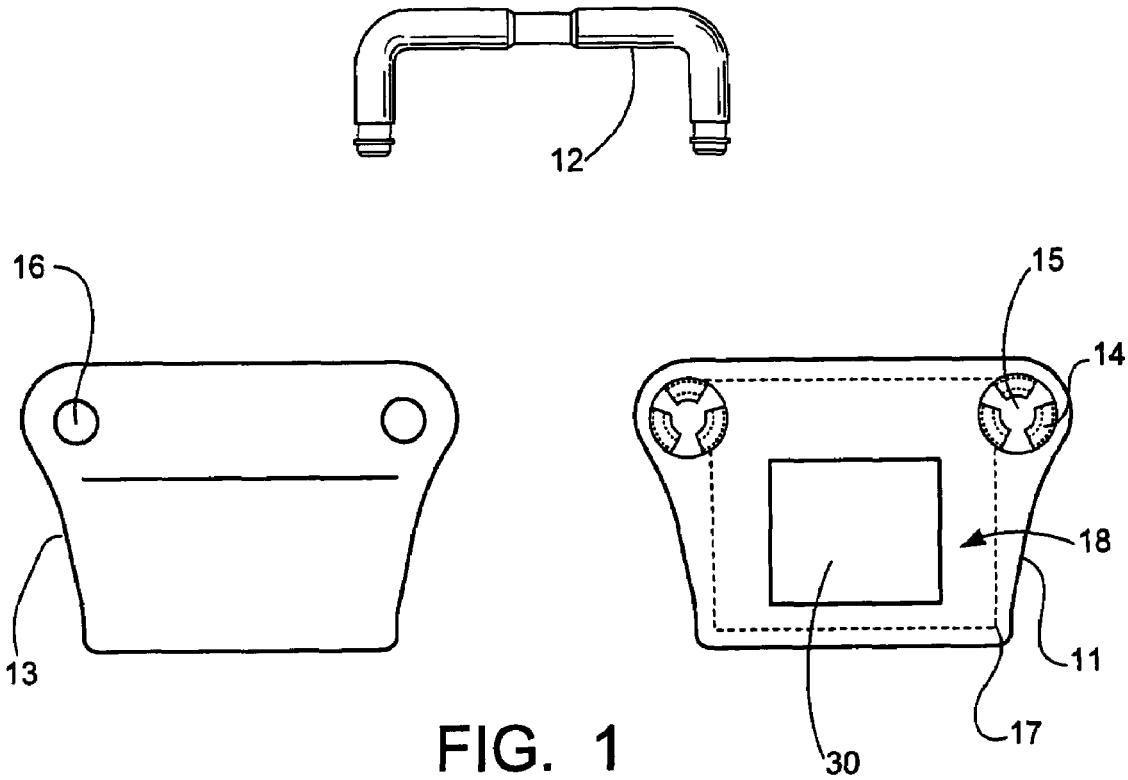
FIG. 1 shows a disassembled view of the first embodiment of the zipper tag housing of the present invention.
Figure 2:
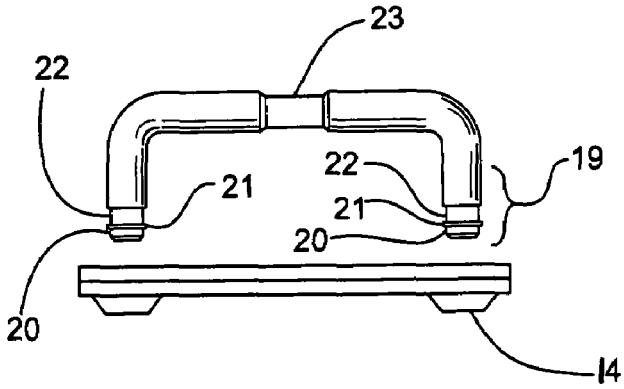
FIG. 2 shows a front view of the tag housing of FIG. 1.
Figure 3:
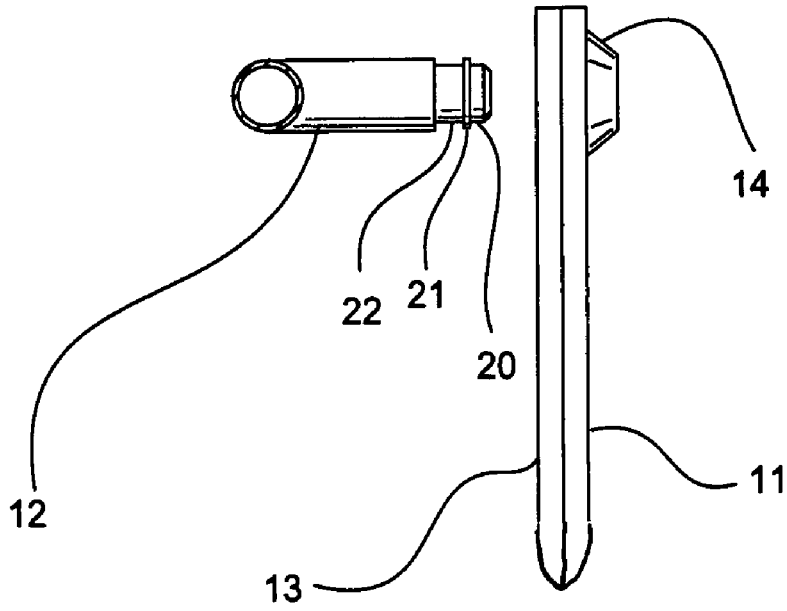
FIG. 3 shows a side view of the embodiment of FIG. 1.
Figure 4:
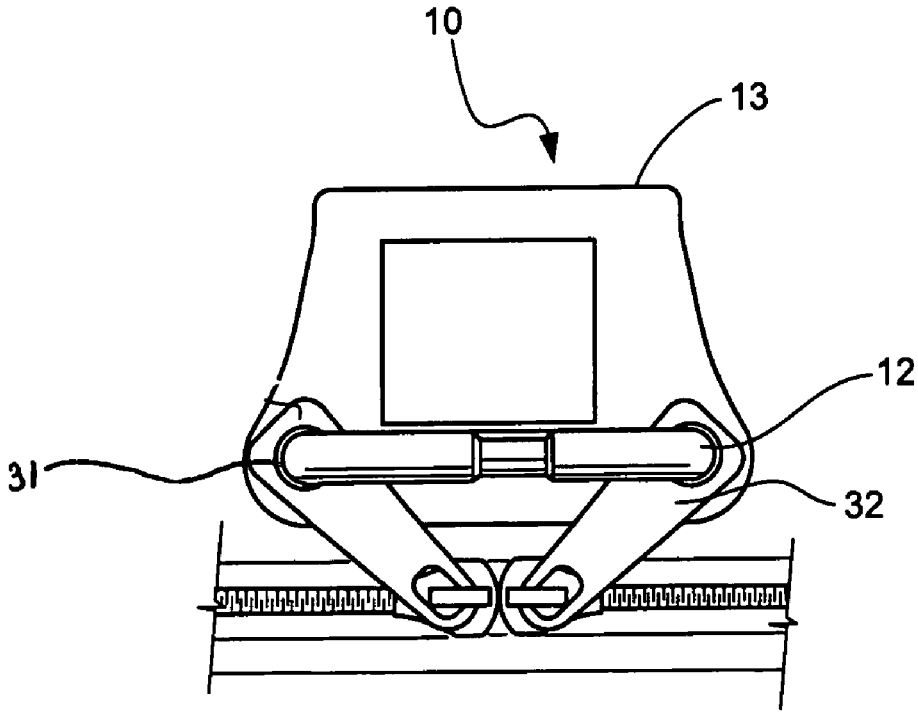
FIG. 4 shows a perspective view of the embodiment of FIG. 1 attached to a zipper packaged product.
Figure 5:
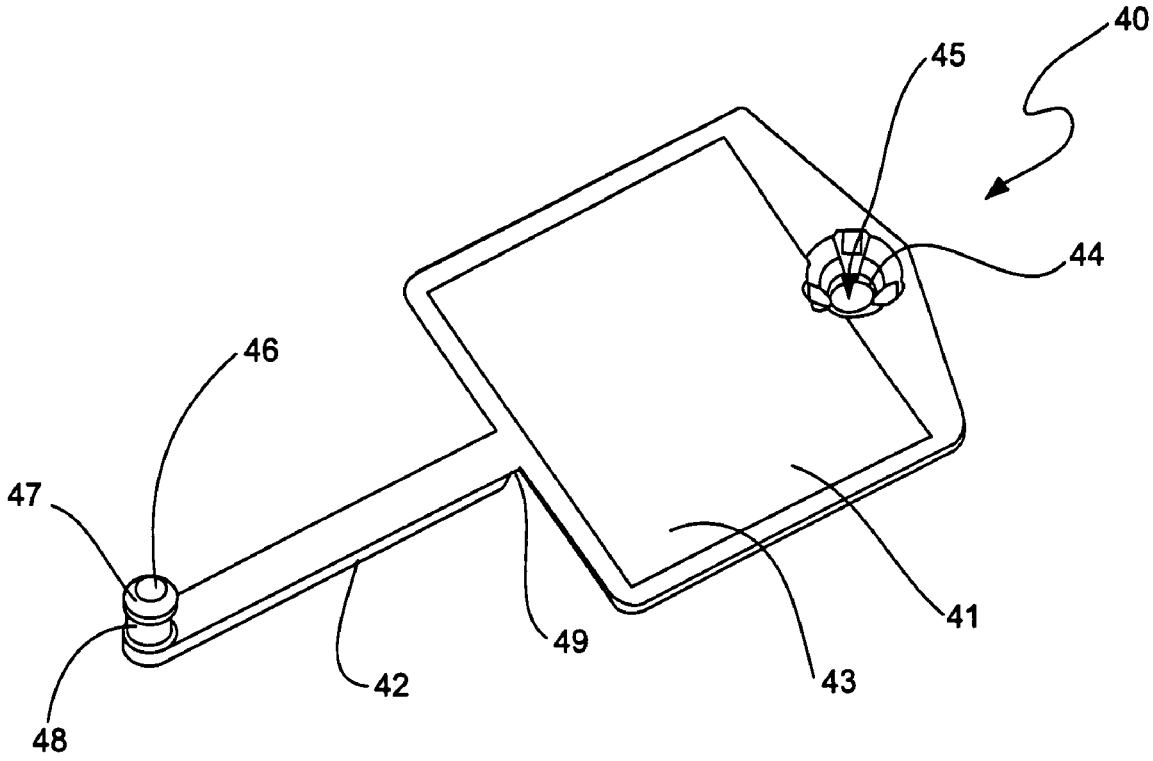
FIG. 5 shows a bottom perspective view of the second embodiment of the zipper tag housing of the present invention.
Figure 6:
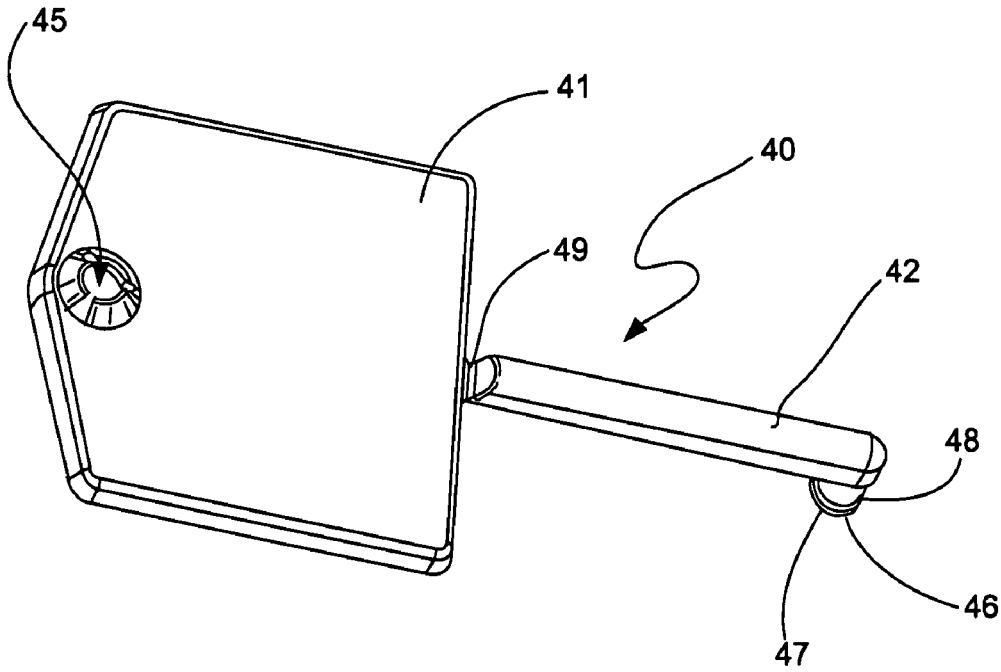
FIG. 6 shows a top perspective view of the embodiment of FIG. 5.
Figure 7:
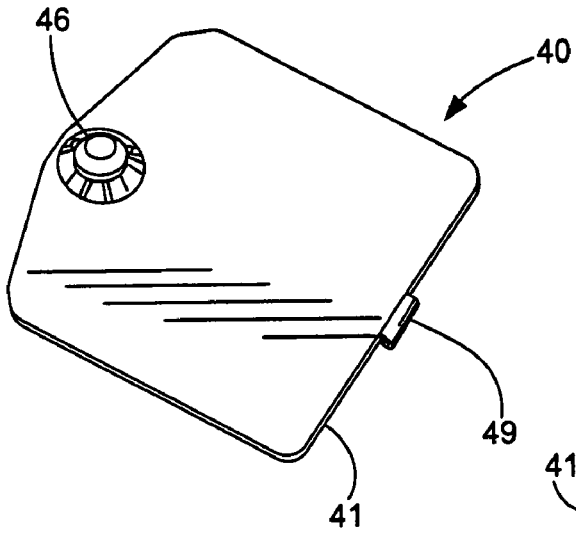
FIG. 7 shows a perspective view of the embodiment of FIG. 6 in the locked position.
Figure 8:
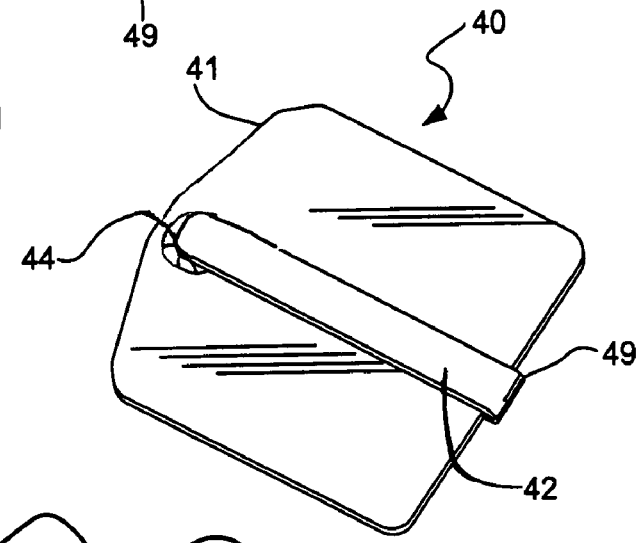
FIG. 8 shows a perspective view of the embodiment of FIG. 5 in the locked position.

Referring to FIGS. 1-4 of the present invention, a first example of one such tag housing is shown. Housing 10 is a molded plastic component to accommodate packaging having double zippers, as shown in FIG. 4. Housing 10 includes a base 11, a cover 13 and a U-shaped arm 12. The base 11 and cover 13 are generally planar and trapezoidal in shape. The base 11 and cover 13 include two parallel sides one being longer then the other, and two non-parallel sides connecting the parallel sides. The non-parallel sides are slightly bowed inwardly as shown in FIG. 1. The base 11 further includes two concaved recesses 14 dramatically opposed and positioned closer to the longer side of base 11. Each recess 14 has an aperture 15 there through positioned adjacent rounded corners of the base. The cover 13 includes two apertures 16 similarly positioned as the apertures 15 closer to the long side of the cover 13. The apertures 15 of base 11 are positioned on the base to line up with the corresponding apertures 16 of the cover 13 when the cover 13 is positioned over the base 11, as shown in FIG. 2.

The base 11 includes a ridge 17 to provide a framed portion 18 for housing a tag 30 therein. The tag 30 may be secured to the housing 10 by adhesive or the like. The cover 13 may be placed over the tag 30 and the base 11 to enclose the tag 30 therein.

The U-shaped arm 12 is may be a variety of shapes and sizes. The arm 12 has two ends 19 which are designed to interlock with the aperture 15 and recess 14 of the base 11. FIG. 2 shows arm 12 spans the distance between the apertures 15 of the base 11. The ends 19 of the arms 12 include tips 20. The tips 20 are generally conical with lead-in geometry. A reduced diameter cylindrical portion 22 connects the tips 20 to the main portion of the arm 12. Further included in the arm 12 is a ridge 21 which is defined as the point where the cylindrical portion 22 connects to the tip 20. Once the tip 20 and ridge 21 pass though the aperture 15 of the base 11, the recess 14 engages with the ridge 21 to prevent the tip 20 from exiting back out of the aperture 15. The arm 12 further includes a necked down portion 23 which is a reduced diameter or weakened portion of the arm 12. The user may remove the housing 10 by cutting through the necked down portion 23, and removing the zippers 32 from the housing 10.

The thickness or diameter of the U-shaped arm 12 is small enough to allow the arm 12 to be threaded through the eye 31 of zipper 32, as shown in FIG. 4. Additionally, the arm 12 must be thick enough to maintain its mechanical integrity preventing premature snapping and removal of the housing 10 from the packaged product.

Housing 10 is assembled by securing a tag 30 to the base 11. The tag 30 may be covered by aligning cover 13 over base 11. The apertures 16 of cover 13 are aligned with the apertures 15 of the base 11. Arm 12 is threaded through one or more eyes 31 of zippers 32. The tips 20 of the arms 12 are pushed through apertures 16 of the cover 13. The tips 20 are pushed through apertures 15 of the base 11 until ridges 21 pass through recesses 14 and aperture 15 to allow the arm 12 to become irreversibly locked into the base 11. The zippers 32 may be moved about the arm 12 to provide limited access to the product within the container. Upon breaking of the arm 12 at the necked down portion 22 the zippers 32 can be removed from the housing 10 allowing for full access to the product within.

FIGS. 5-9 show the second embodiment of the present invention including a housing 40 which is secured to the packaging to prevent the zipper from opening beyond the placement of the housing 40.

Housing 40 includes a generally planar rectangular portion 41 and a tail 42 depending therefrom. The planar portion 41 includes a recessed area 43 to provide for attachment of a tag (not shown). The tag may be secured to the planar portion 41 by adhesive or the like. A cover may be placed thereover.

The planar portion 41 further includes a concaved recess 44 with an aperture 45 therethrough. The concaved recess 44 is positioned at the opposite side of the planar portion 41 from the tail 42.

The tail 42 includes a button 46 which is similar to tip 20 as above described in reference to FIG. 1. Button 46 is perpendicularly projection portion with a tip 47 and a ridge 48 to mate with the aperture 45 of planar portion 41. The tail 42 is designed to bend at the bend point 49. The tail 42 folds back over the planar portion 41 at the bend point 49 such that the button 46 aligns with recess 44. The button 46 is manually pushed through opening 45 until the ridge 48 passes through the aperture 45 to prevent the tip 47 from being removed once it has attached or snap-locked into the aperture 45 and recess 44. The locking of the button 46 and the housing 40 prevent the zipper from being removed therefrom.

Figure 9:
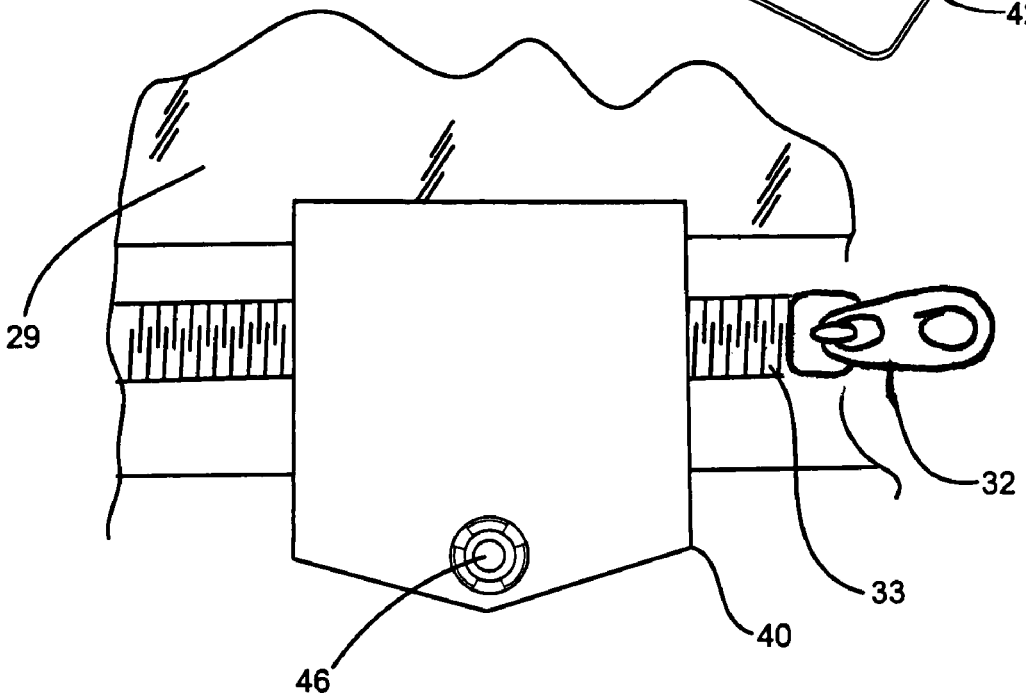
FIG. 9 shows a perspective view of the embodiment of FIG. 8 attached to a zippered product.

FIG. 9 shows housing 40 attached to packaging 29 inserting tail 42 through a hole made in the packaging 29. The tail 42 crosses over one side of the zippering portion 33 and the planar portion 41 crosses over the other side of the zippering portion 33. The tail 42 is locked into the planar portion 41 by a cooperative locking mechanism defined by the aperture 45 and button 46 interlock. The zipper 32 cannot advance beyond the housing 40 which traverses its path to allow for viewing the product with limited access thereto.

Having described particular embodiments of the present invention herein, it should be appreciated by those skilled in the art that modifications may be made thereto without departing from the contemplated scope thereof. Accordingly, the embodiments described herein are intended to be illustrative rather than limiting, the true scope of the invention being set forth in the claims appended hereto.

What is claimed is:

1. A housing for supporting an electronic tag for a zippered container comprising:

a planar trapezoidal shaped base, said base including a pair of base apertures therethrough adjacent corners of said base;

a cover including a pair of cover apertures which correspond to said base apertures, said cover fitting over said base to allow an electronic tag to be supported therebetween; and a locking arm having two ends and a U-shaped body therebetween, said locking arm irreversibly attaches said cover to said base by extending said arm ends through said pair of cover apertures and said pair of said base apertures.

2. The housing of claim 1 wherein said locking arm includes a reduced material section on said U-shaped body to allow a weakened portion for removal of the housing.

3. The housing of claim 2 wherein each of said ends of said arm includes an irreversible locking member including a tip having lead-in geometry and a ridge, said ridge is radially thicker than said tip, said locking member is permitted one-way entry through said base apertures and said ridge of said locking member prevents said arm from releasing from said base apertures once said tip has been extended therethrough.

4. The housing of claim 3 wherein said base includes a recess portion about said base apertures.

5. The housing of claim 1 wherein said base and said cover have similar shape.

6. The housing of claim 1 wherein said base includes two parallel sides and one of said parallel sides is longer than the other of said parallel sides.

7. The housing of claim 6 wherein said base includes two non-parallel sides, a portion of said non-parallel sides are bowed inwardly toward each other.

8. The housing of claim 1 wherein said base having an inner surface and an outer surface, said inner surface opposing said cover and said inner surface includes a protruding rim inset from a perimeter of said base.

9. The housing of claim 3 wherein said tip is conical.

10. The housing of claim 2 wherein said arm includes a necked down portion with a reduced diameter.

11. The housing of claim 1 wherein said base includes two parallel sides and one of said parallel sides is longer than the other of said parallel sides, said base apertures positioned closer to said one of said parallel sides.

12. The housing of claim 1 wherein said base includes a recess portion about each of said base apertures.

13. The housing of claim 1 further including an electronic tag supported between said base and said cover.

14. A security device for a zippered container comprising:

a planar trapezoidal shaped base, said base including a pair of recess portions, each recess portion includes a base aperture through said base, said base includes two parallel sides, one of said parallel sides is longer than the other of said parallel sides, said base apertures positioned closer to said one of said parallel sides;

a cover similar in shape to said base, said cover including a pair of cover apertures which correspond to said base apertures, said cover mating with said base to allow an electronic tag to be supported therebetween;

a locking arm having two ends and a U-shaped body therebetween, said locking arm irreversibly attaches said cover to said base by extending said arm ends through said pair of cover apertures and said pair of said base apertures; and an electronic tag supported between said base and said cover.

* * * * *